US006199486B1

(12) United States Patent
Landrum et al.

(10) Patent No.: US 6,199,486 B1
(45) Date of Patent: Mar. 13, 2001

(54) FLATBED RAILCAR WITH A CENTER SUPPORT PARTITION

(75) Inventors: Scott C. Landrum, Keller; Robert J. Edwards, Fort Worth, both of TX (US)

(73) Assignee: The Burlington Northern and Santa Fe Railway Company

( * ) Notice: Subject to any disclaimer, the term of this patent is extended or adjusted under 35 U.S.C. 154(b) by 0 days.

(21) Appl. No.: 09/191,028

(22) Filed: Nov. 12, 1998

(51) Int. Cl.[7] ..... B61D 3/08

(52) U.S. Cl. ..... 105/396; 105/355; 105/406; 105/407; 105/411; 410/35; 410/37; 410/38

(58) Field of Search ..... 105/355, 396, 105/404, 407, 411, 247; 410/31, 32, 33, 34, 35, 36, 37, 38, 39, 40, 41, 42

(56) References Cited

U.S. PATENT DOCUMENTS

| | | | | |
|---|---|---|---|---|
| 3,734,031 | * | 5/1973 | Wagner | 105/367 |
| 4,543,887 | * | 10/1985 | Baker | 105/355 |
| 4,784,067 | * | 11/1988 | Harris | 105/355 |
| 4,802,420 | * | 2/1989 | Butcher | 105/355 |
| 5,088,417 | * | 2/1992 | Richmond | 105/411 |
| 5,582,495 | * | 12/1996 | Schroeder | 410/32 |
| 5,626,083 | * | 5/1997 | Saxton | 105/355 |

* cited by examiner

*Primary Examiner*—S. Joseph Morano
*Assistant Examiner*—Frantz Jules
(74) *Attorney, Agent, or Firm*—Melvin A. Hunn; James E. Walton

(57) ABSTRACT

An improved railcar is provided which may be utilized for the transport of relatively lightweight bulky articles, as well as relatively heavy articles such as steel beams. The railcar includes a number of components which cooperate to allow such diversity of uses. A rectangular base structure is provided. A substantially planar deck is secured to the upper surface of the rectangular base structure. A plurality of rail wheel assemblies are coupled to the lower surface of the base structure. The rail wheel assemblies are adapted for engaging a railroad. A first bulkhead member is coupled to a first end of the base structure. A second bulkhead member is coupled to the second end of the base structure. A vertical center partition member is also provided. The vertical center partition member is substantially perpendicular to the base structure. It is located along a longitudinal centerline relative to the base structure. It extends between the first and second bulkhead members, and is coupled to the first and second bulkhead members in force-transference relationship therewith. The vertical center partition member provides lateral bending stiffness, vertical bending stiffness, and torsional stiffness. The vertical center partition is substantially uniform in width over its duration. This facilitates loading and unloading operations utilizing overhead cranes.

19 Claims, 9 Drawing Sheets

FLATBED RAILCAR WITH A CENTER SUPPORT PARTITION

BACKGROUND OF THE INVENTION

1. Field of the Invention

The present invention relates in general to rail cars, and in particular to rail cars which are utilized for carrying bulky items ranging from lumber and drywall to steel bars.

2. Description of the Prior Art

In the prior art, a certain type of railcar, which is known as a "centerbeam railcar," is utilized to carrying lumber and drywall. Because the loads are relatively light, the centerbeam railcar need not be excessively reinforced. Additionally, centerbeam railcars are not generally useful for carrying steel beams or other similar heavy loads, since the loading requirement for a steel-carrying railcar is substantially greater than that of lumber-carrying railcars.

In a centerbeam car, a central partition is provided which runs along the longitudinal axis of the railcar between relatively lightweight bulkheads. A structural section is provided which is generally horizontal to the bed of the car. This horizontal structural section is referred to as the "top section." In the prior art, the top section is about three feet wide, runs the full length of the car, and serves to give the car much of its lateral stiffness, vertical bending stiffness, and torsional stiffness. However, the horizontal structural section impedes the utilization of overhead cranes for loading; instead, forklifts and other lateral lifting devices are utilized.

A series of risers are provided on the deck of the prior art centerbeam railcar. The risers are slightly declined toward the center partition. Vertical posts which make up the center partition are tapered as they extend upward from the deck of the railcar. When lumber and drywall and loaded onto the declined risers, they "lean into" the center. The deck of the car has very little strength between the risers and the risers themselves are not designed to handle especially concentrated loads, since lumber and drywall loads are distributed equally on the risers and along the full length of the car.

Altogether different railcars are utilized for the hauling of steel beams. Short beams are hauled in gondolas or on short bulkhead flat railcars. The longer beams are hauled on very long flat cars. The decks of these cars must be heavily reinforced to allow the loading of the various lengths of steel beams. Unlike lumber loads, loads of steel beams are not generally uniformly distributed. Additionally, the bulkheads utilized in steel-carrying cars must be designed for the extreme impact generated by the movement of the steel beams.

In general, railcars are relatively expensive to purchase and maintain. The profitability of a railroad is determined in substantial part by the efficiency of operation. Efficiency can be increased by minimizing the total number of cars required to meet all of the customers' needs. Additionally, efficiency can be increased by minimizing the transport of empty cars, whenever possible. Profitability may also be increased by facilitating the ease with which loads are loaded or unloaded from railcars, thus speeding up such operations. Additionally, minimizing the possibility of damage to transported articles in transit or in loading can also affect profitability.

SUMMARY OF THE INVENTION

It is one objective of the present invention to provide an improved railcar which can serve multiple functions, including the transportation of relatively light loads such as lumber and drywall, but which can also be utilized to transport relatively heavy loads such as steel beams.

It is an additional objective of the present invention to provide an improved railcar which can be utilized to transport different types of articles, as discussed above, but which increases the ease with which articles are loaded and unloaded from the railcar utilizing overhead cranes, as opposed to requiring the utilization of forklifts.

These and other objectives are achieved as is now generally described. A railcar is provided which may be utilized to transport both relatively light loads (such as lumber and drywall) and relatively heavy loads (such as steel beams), which is made up of a number of components. A generally rectangular base structure is provided. A substantially planar deck covers the upper surface of the generally rectangular base structure. A plurality of rail wheel assemblies are coupled to the lower surface of the base structure and the rail wheel assemblies are adapted for engaging a railroad. A first bulkhead member is coupled to a first end of the base structure and a second bulkhead member is coupled to a second end of the base structure and to the first and second bulkheads. A vertical center partition member is provided in a substantially perpendicular position relative to the base structure. The vertical center partition member is located along a longitudinal centerline relative to the base structure. The vertical center partition member extends between the first and second bulkhead members, and is coupled to the first and second bulkhead members in force transference therewith. The vertical center partition member provides lateral bending stiffness, vertical bending stiffness, and torsional stiffness.

In the preferred embodiment of the present invention, the vertical center partition member has a substantially uniform width from a lowermost portion which is adjacent the substantially planar deck to an uppermost portion, in order to facilitate loading and unloading operations utilizing overhead cranes. Additionally, in the preferred embodiment of the present invention, the center partition member includes a plurality of tubular vertical posts which provide lateral bending stiffness for the improved railcar. The tubular vertical posts are positioned in particular locations; along the longitudinal centerline of the improved railcar, and are secured to the generally rectangular base structure and the substantially planar deck. Additionally, in accordance with the preferred embodiment of the present invention, the vertical center partition member includes a tubular top rail which is located at the uppermost portion of the vertical center partition. The tubular top rail extends between the first and second bulkheads and provides vertical bending stiffness. Additionally, in accordance with the preferred embodiment of the present invention, the vertical center partition member includes a plurality of diagonal brace members extending between the plurality of vertical posts to provide torsional stiffness.

The above as well as additional objectives, features, and advantages will become apparent in the following description.

BRIEF DESCRIPTION OF THE DRAWINGS

The novel features believed characteristic of the invention are set forth in the appended claims. The invention itself however, as well as a preferred mode of use, further objectives and advantages thereof, will best be understood by reference to the following detailed description of the preferred embodiment when read in conjunction with the accompanying drawings, wherein:

DETAILED DESCRIPTION OF THE INVENTION

Although the invention has been described with reference to a particular embodiment, this description is not meant to be construed in a limiting sense. Various modifications of the disclosed embodiments as well as alternative embodiments of the invention will become apparent to persons skilled in the art upon reference to the description of the invention. It is therefore contemplated that the appended clams will cover any such modifications or embodiments that fall within the scope of the invention.

Figure 1:
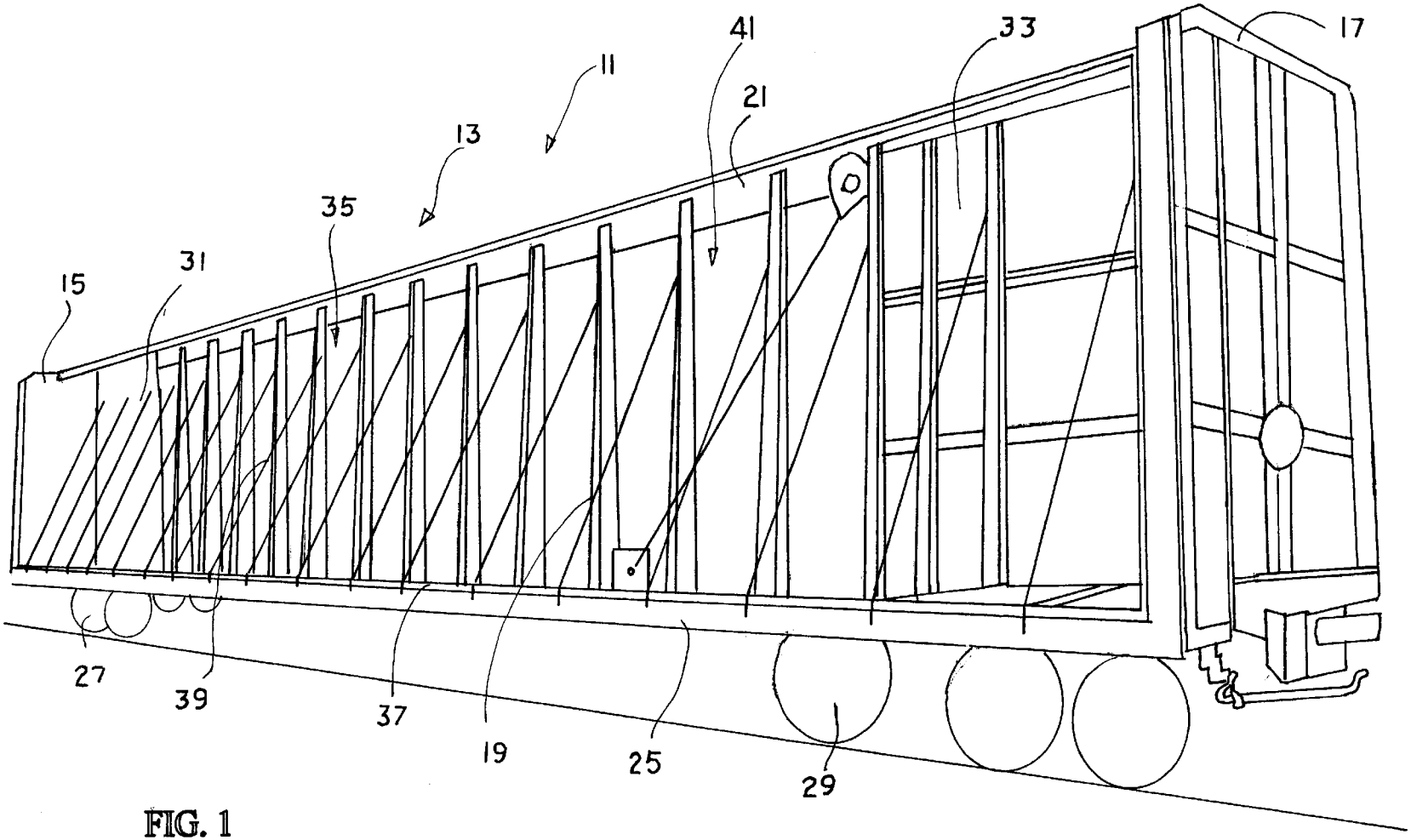
FIG. 1 PRIOR ART
FIG. 1 is a pictorial representation of a prior art "centerbeam" rail car which may be utilized for the transport of lumber, drywall, logs, and other similar lightweight but bulky items.

FIG. 1 is a pictorial and perspective representation of a prior art "centerbeam" railcar 11 which is utilized to transport relatively lightweight, bulky items, such as lumber, logs, and drywall. Centerbeam railcar 11 includes a substantially rectangular base 25, which is carried by wheel assemblies 27, 29. Relatively lightweight bulkheads 15, 17 are provided at each end of centerbeam railcar 11. A center partition member 13 is provided which includes a generally horizontal structural member 21 and a generally vertical structural member 41. Horizontal structural member 21 and vertical structural member 41 extend the length of centerbeam railcar 11 between bulkheads 15, 17. The horizontal structural member 21 is approximately three feet wide, and runs the full length of the car. This horizontal structural member 21 is located approximately ten feet above the bed of the car, and serves to give the car much of its lateral stiffness, vertical bending stiffness, and torsional stiffness. (The vertical structural members 41 are relatively lightweight, and are not primarily involved in providing torsional stiffness for centerbeam railcar 11). Adjacent each of bulkheads; 15, 17 is a relatively solid section 31, 33 of vertical walls. Between the solid sections 31, 33 are a plurality of vertical, tapered members 19. The vertical members are wider adjacent the bed of centerbeam railcar 11, and are tapered as they extend upward into engagement with horizontal structural section 21. A plurality of risers 37 are provided on the bed of centerbeam railcar 37 which serve to tilt the relatively lightweight loads inward toward the center partition. A plurality of steel cables 39 are utilized to secure the relatively lightweight loads in position relative to centerbeam railcar 11.

Centerbeam railcar 11 is not at all useful for carrying relatively heavy-weight articles such as steel beams. First, the centerbeam railcar is not designed to carry concentrated loads, and is instead well suited for carrying loads that are well distributed along the length of the car. Consequently, different types of cars are need to haul steel beams and other similar heavy loads. For example, short beams may be hauled in gondola-type railcars, or on short bulkhead flat railcars. Longer beams are typically carried on long flat cars. The decks of these steel-carrying railcars must be heavily reinforced to allow loading on the various lengths of steel beams, since the loads are not always uniformly distributed like encountered with lumber, drywall, or log loads. Additionally, for the steel-carrying railcars, the bulkheads must be designed for the extreme impact generated by movement of the steel beams. A traditional centerbeam bulkhead railcar would not be strong enough to withstand the impact generated by steel beams.

The present invention provides a single railcar which is equally well suited for carrying relatively lightweight loads, such as lumber, logs, and drywall, but which also can be utilized to carry relatively heavy-weight loads such as steel beams. One significant advantage of the present invention is that, unlike the centerbeam railcar 11 of FIG. 1, an overhead crane may be utilized for loading and unloading operations. This is not possible with a centerbeam railcar, such as that depicted in FIG. 1, since the horizontal portion of the center partition effectively bars the use of most conventional overhead crane devices. Instead, a centerbeam railcar is loaded and unloaded utilizing forklifts and other lateral-type lifting devices. In most instances, the height of the center partition (about eleven feet, ten inches, above the deck) interferes with the utilization of overhead cranes.

Figure 2A:
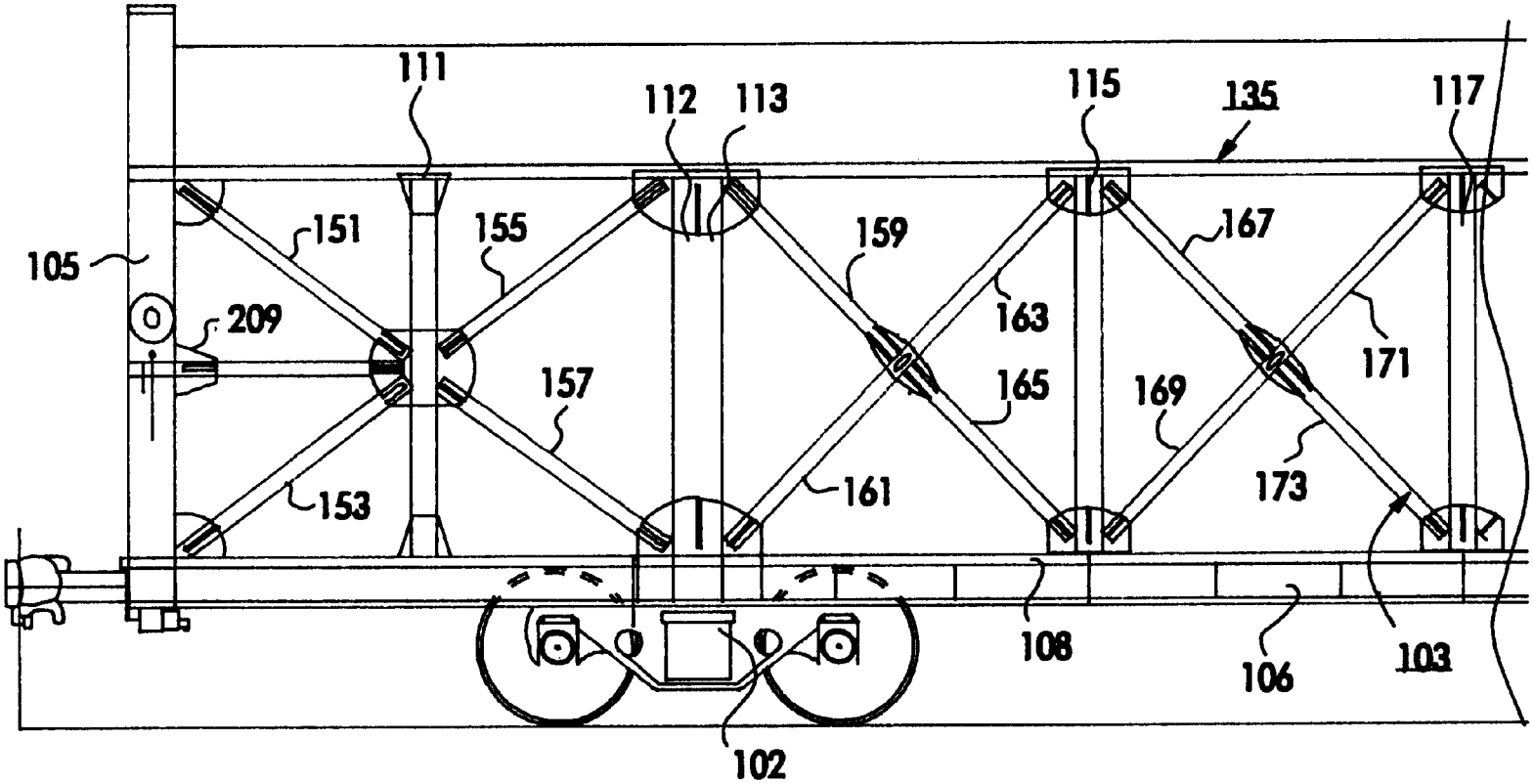
FIG. 2 is a pictorial side view representation of the flatbed railcar with a center support partition in accordance with the preferred embodiment of the present invention.
Figure 2B:
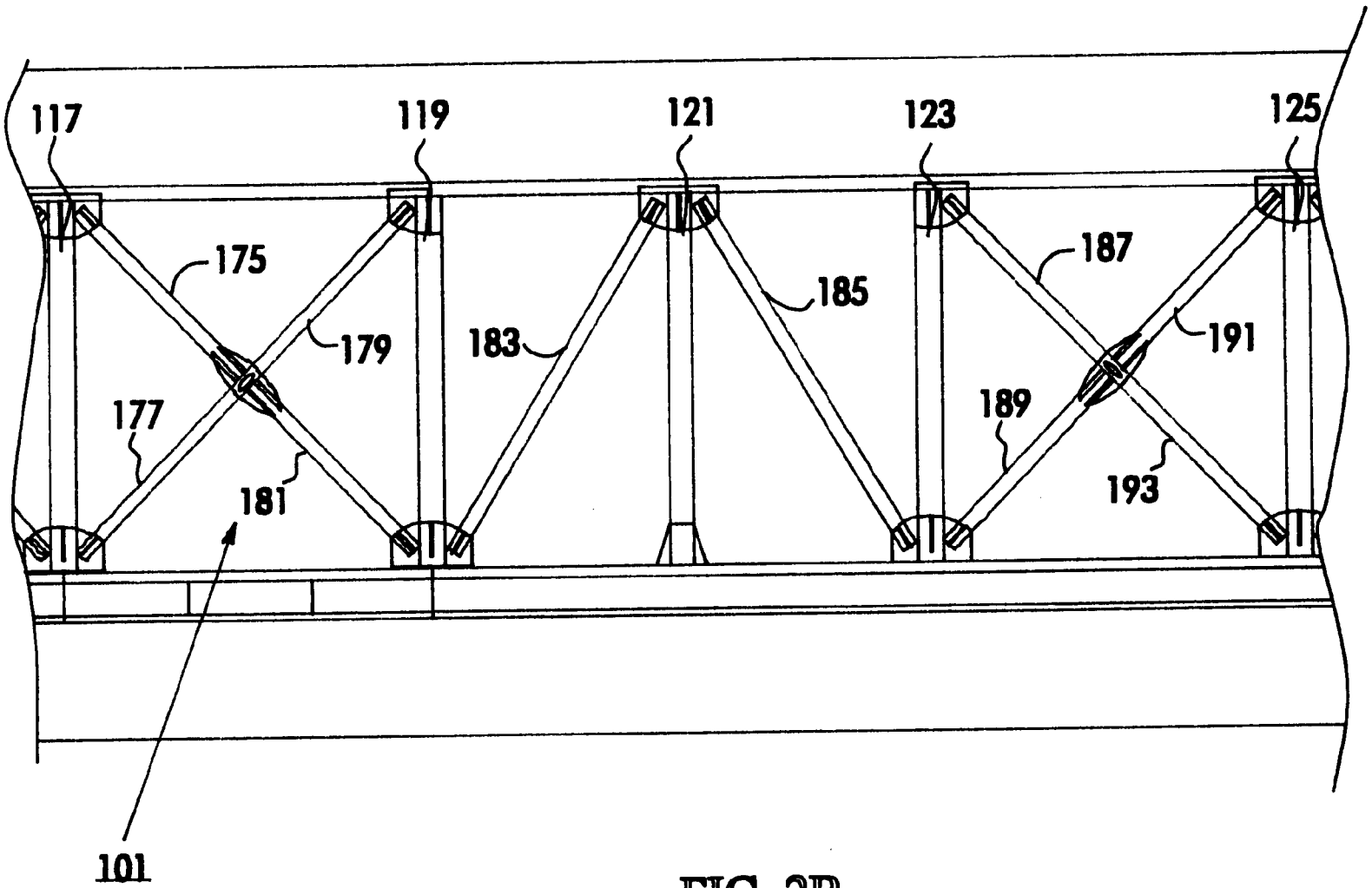
Figure 2C:
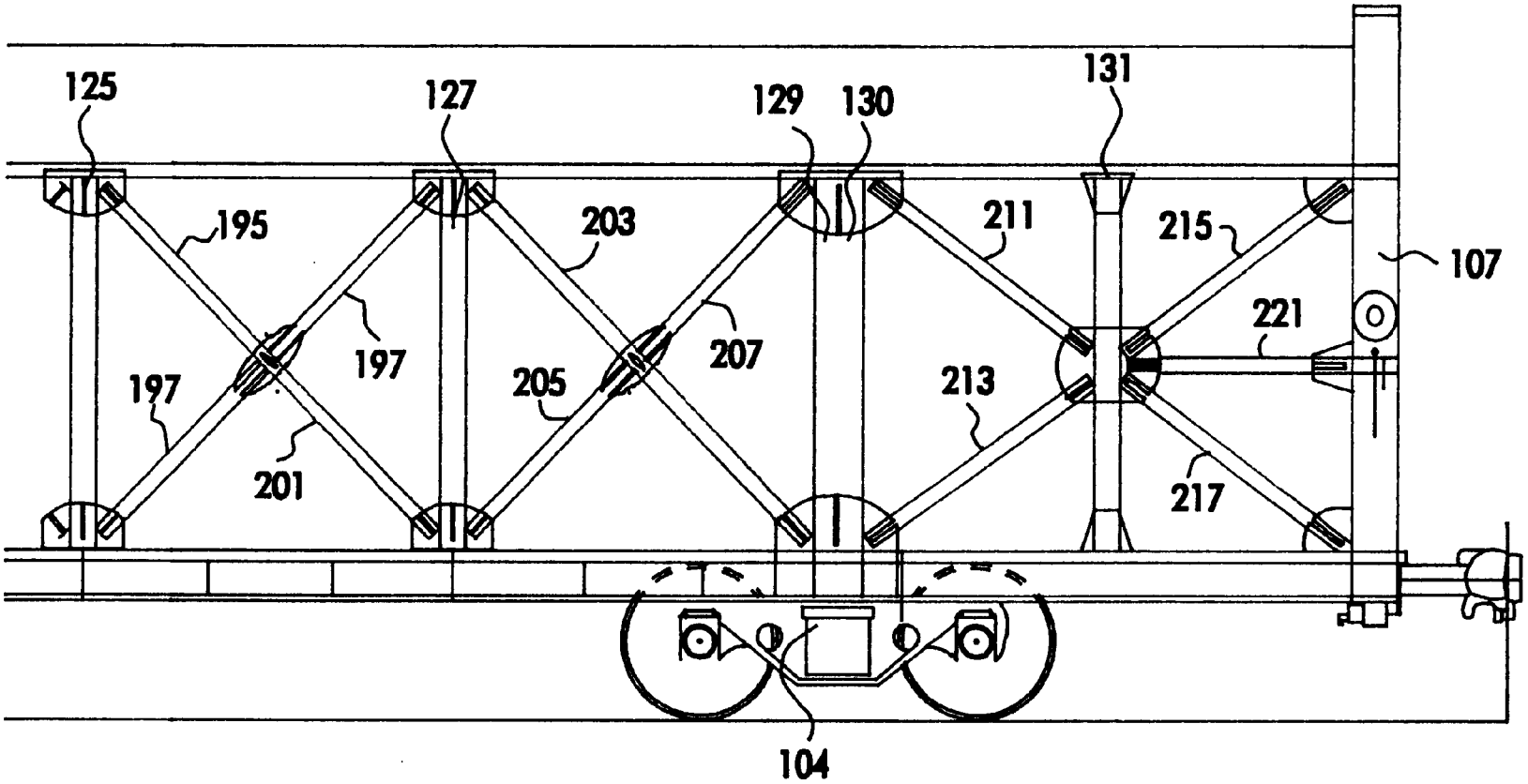

FIG. 2 is side view of the flatbed railcar 101 with center partition 103 constructed in accordance with the preferred embodiment of the present invention. A generally rectangular base structure 106 is provided which is sufficiently strong to carry highly concentrated heavy loads which are not evenly distributed, such as steel beams. An upper deck 108 is provided above the generally rectangular base structure 106. Rail wheel assemblies 102, 104 are coupled to the underside of rectangular base structure 106, and are conventional in all respects, and adapted for engaging a railroad structure. A first bulkhead member 105 is provided at one end of rectangular base structure 106. A second bulkhead member 107 is provided at the opposite end of rectangular base structure 106.

A vertical center partition member 103 is provided on flatbed railcar 101. Vertical center partition member 103 extends along the entire length of flatbed railcar 101. It is located along a longitudinal axis, and thus is located in a mid-position along deck 108. Vertical center partition member 103 is made up of a number of components. Preferably, it is of substantially uniform width along its entire height. In the preferred embodiment of the present invention, vertical center partition member 103 extends eight feet above deck 106 of flatbed railcar 101. This allows the utilization of conventional overhead cranes for loading and unloading operations which are not possible utilizing the prior art centerbeam car, as will be discussed and depicted below.

The vertical center partition member 103 operates to provide lateral bending stiffness, vertical bending stiffness, and torsional stiffness. The vertical center partition member does not utilize any horizontal structural members, such as that utilized in the prior art centerbeam cars discussed above. Preferably, the vertical center partition member 103 is made up of tubular steel members which are welded and fastened together in a predetermined manner. Preferably, the vertical center partition member 103 22 includes a plurality of tubular vertical posts 111, 112, 113, 115, 117, 119, 121, 123, 125, 127, 129, 130, and 131. These tubular vertical posts provide lateral bending stiffness. Additionally, in accordance with the preferred embodiment of the present invention, the vertical center partition member 103 further includes a tubular top rail 135 which extends along the entire length of flatbed railcar 101, which is coupled to first and second bulkheads 105, 107, and which is also coupled to the plurality of vertical posts. The tubular top rail 135 provides vertical bending stiffness. In addition, and in accordance with the preferred embodiment of the present invention, the vertical center partition member 103 further includes a plurality of tubular diagonal brace members which provide torsional stiffness. These diagonal base members will now be described with reference to FIG. 2. Diagonal brace members 151, 153 extend between bulkhead 105 and tubular vertical post 111. Diagonal brace members 155, 157 extend between tubular vertical brace members 111, 112. Diagonal brace members 159, 161, 163, 165, extend between tubular vertical posts 113, 115. Diagonal brace members 167, 169, 171, 173 extend between tubular vertical posts 115, 117. Diagonal brace members 175, 177, 179, 181 extend between tubular vertical posts 117, 119. Diagonal brace 183 extends between tubular vertical posts 119, 121. Diagonal brace 185 extends between tubular vertical posts 121, 123. Diagonal brace members 187, 189, 191, 193 extend between tubular vertical posts 123, 125. Diagonal brace members 195, 197, 199, 201, extend between tubular vertical posts 125, 127. Diagonal brace members 203, 205, 207, 209 extend between tubular vertical posts 127, 129. Diagonal brace members 211, 213, extend between tubular vertical posts 130, 131. Diagonal brace members 215, 217 extend between tubular vertical post 131 and bulkhead 107. In addition to the tubular diagonal brace members, horizontal brace 219 extends between bulkhead 105 and tubular vertical post 111, while horizontal brace 221 extends between tubular and vertical post 131 and bulkhead 107.

Figure 3A:
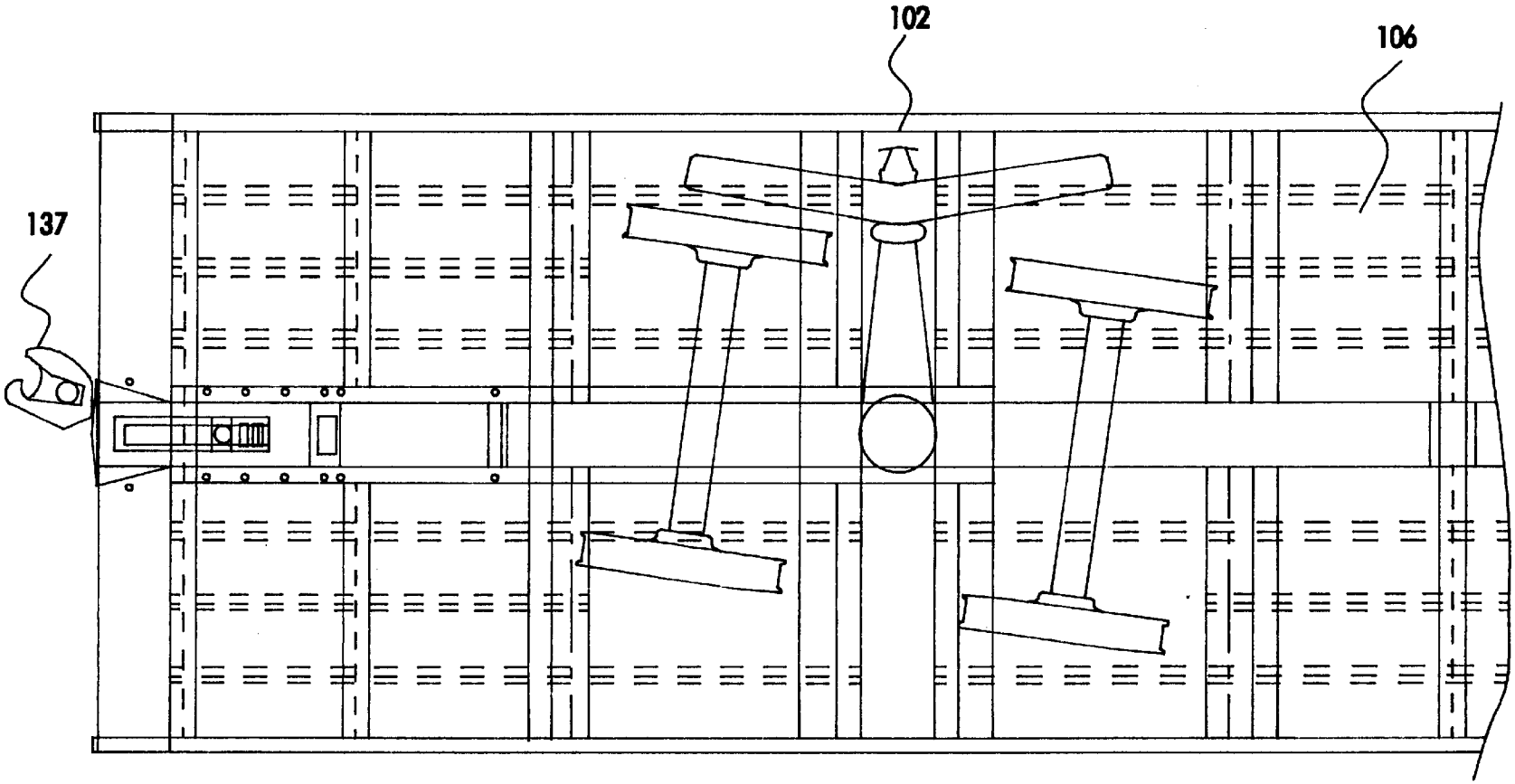
FIG. 3 is a top plan view of the undercarriage of the flatbed railcar of the preferred embodiment of the present invention.
Figure 3B:
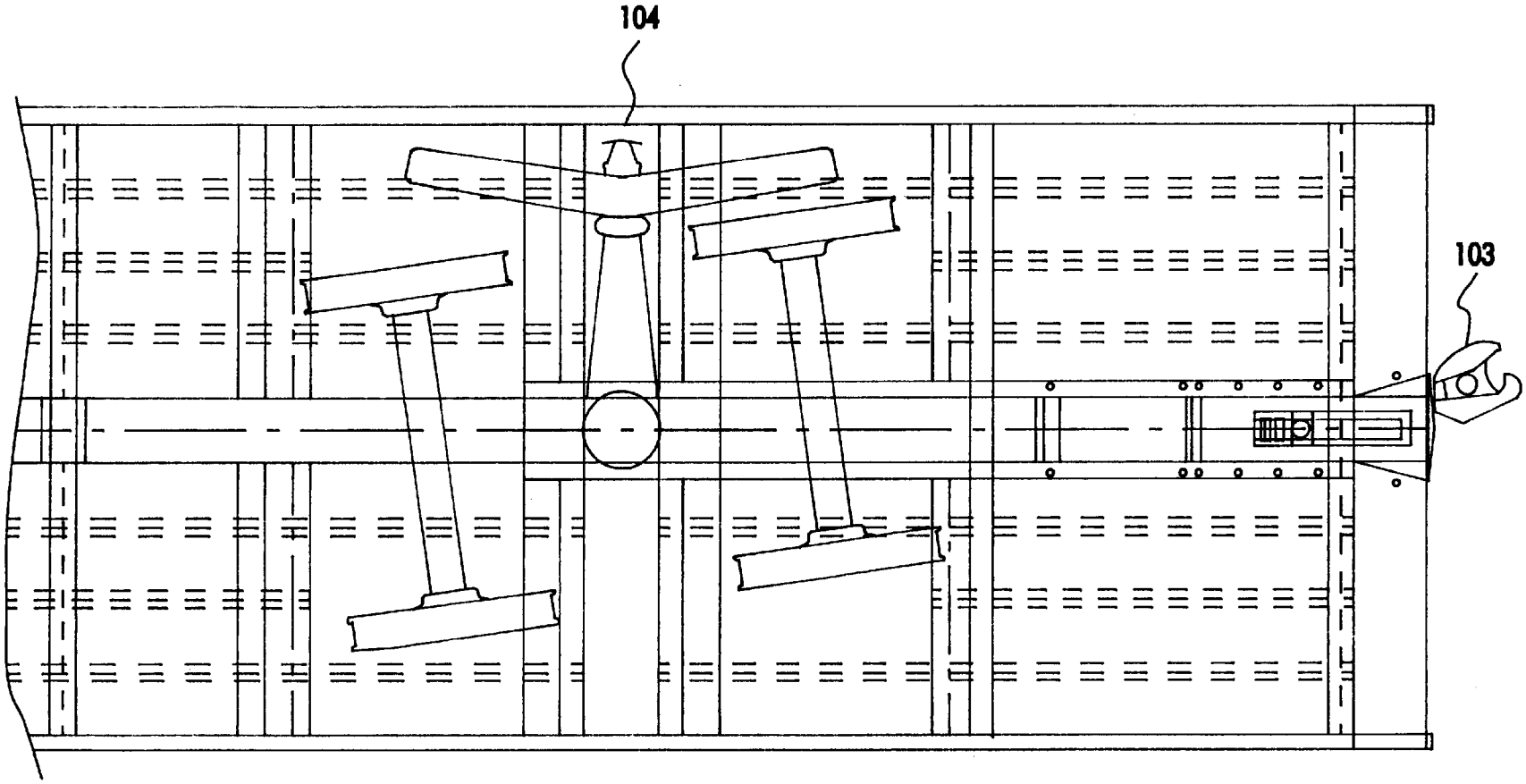

FIG. 3 is a plan view of the under carriage of flatbed railcar 101 of FIG. 2. As is shown, rail wheel assemblies 102, 104 are adapted, in a conventional manner, to allow the railcar to pass along curved rails. Additionally, rectangular base structure 106 is composed of a plurality of intersecting structural members which are strong enough to carry the highly concentrated and heavy loads of steel beams. Additionally, as is conventional, flatbed railcar 101 is equipped with coupling members 137, 139, which allow for coupling and decoupling of the car, into and out of, a string of cars.

Figure 4:
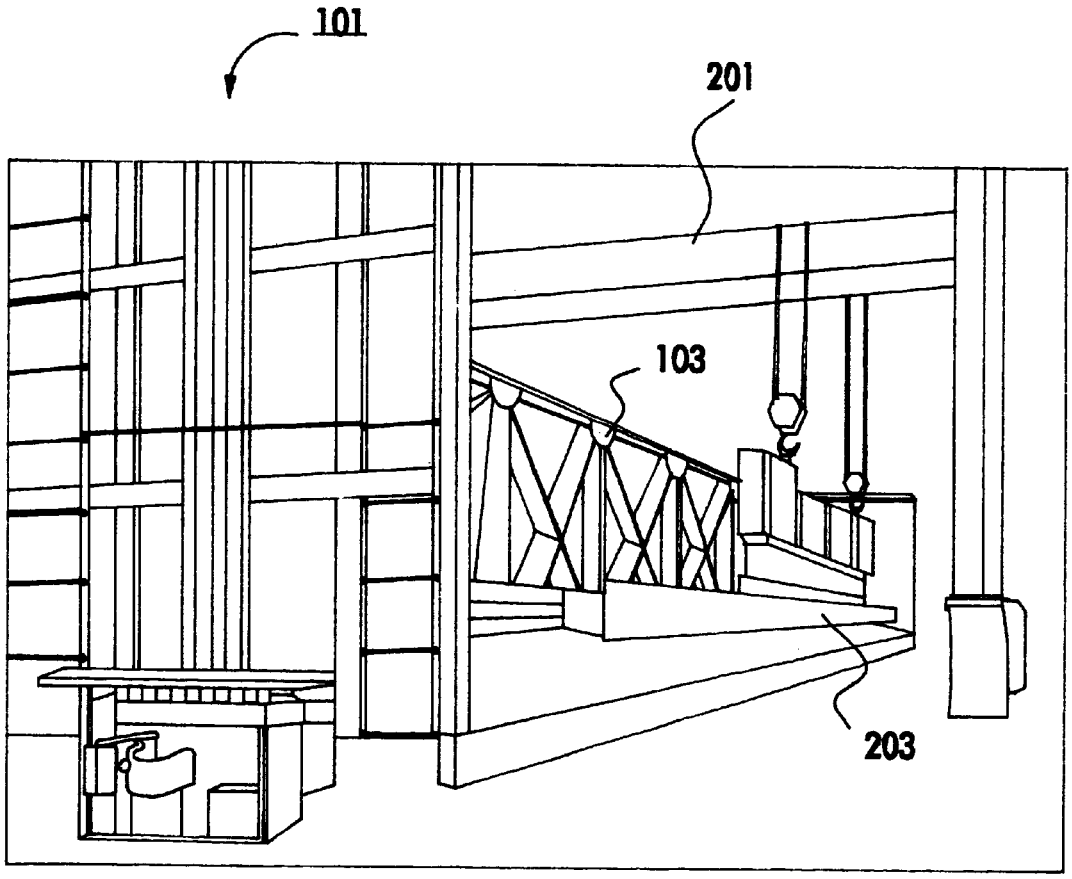
FIG. 4 is a pictorial representation of the utilization of overhead cranes for loading articles (such as steel beams) on the improved flatbed railcar of the present invention.

FIG. 4 is a perspective view of flatbed railcar 101, constructed in accordance with the present invention, with center partition member 103 extending eight feet above the bed of the car. As is shown, overhead crane 201 may be utilized to load articles, such as steel 203 onto the bed of flatbed railcar 101. As is shown, the overhead crane 201 may be utilized to load and unload each side of the railcar, since vertical center partition member 103 is low enough to allow the load to be lifted completely above the vertical center partition member 103. This is advantageous over the prior art centerbeam railcar, since articles may be loaded and unloaded more quickly utilizing the overhead crane, since there is no horizontal structural component which blocks the use of the crane, or which blocks the crane operator's view of the railcar, and since there is a much lower probability of damage during loading and unloading operations than that encountered utilizing lateral lifting devices, such as forklifts.

Figure 5:
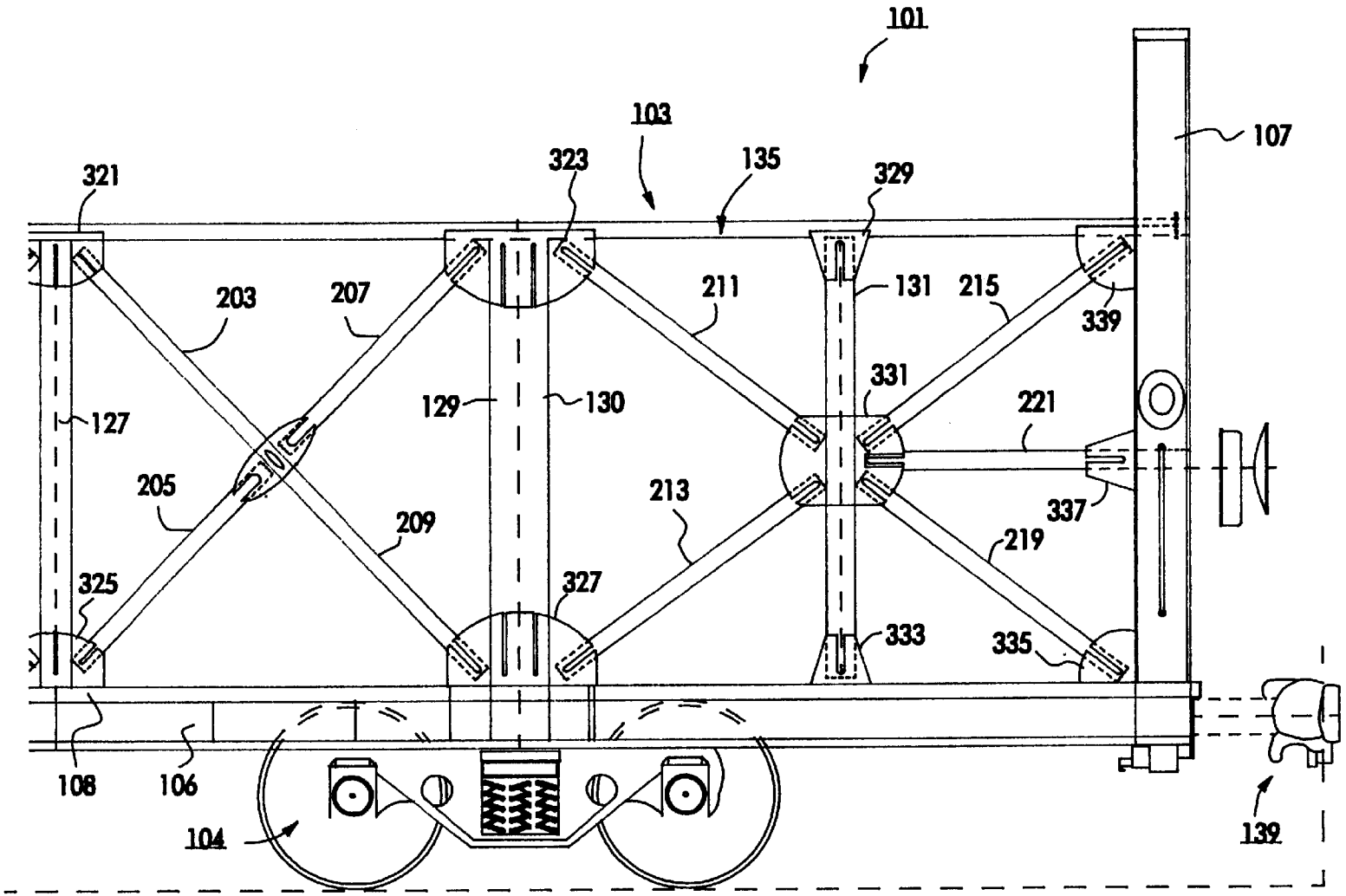
FIG. 5 is a fragmentary side view of the improved flatbed railcar with center partition member in accordance with the preferred embodiment of the present invention.

FIG. 5 is a detailed view of a portion of flatbed railcar 101 constructed in accordance with the preferred embodiment of the present invention. As is shown, rectangular base structure 106 has a substantially planar deck 108 at its upper surface, and is coupled to rail wheel assembly 104 at its lower surface. Bulkhead 107 is provided. Additionally, vertical center partition member 103 is rigidly coupled to generally rectangular base structure 106, and bulkhead 107. Vertical center partition member 103 includes (in the view of FIG. 5) tubular vertical posts 127, 129, 130, and 131. Tubular top rail 135 is also provided. The plurality of tubular diagonal brace members 203, 205, 207, 209 are provided between tubular vertical posts 127, 129. Additionally, tubular diagonal brace members 211, 213 are provided between tubular vertical post members 130, 131. Tubular diagonal brace members 215, 219 are provided are between tubular vertical post member 131 and bulkhead 107. Horizontal brace member 221 is provided between bulkhead 107 and tubular vertical post 131.

In the view of FIG. 5, dimensions are provided to show the relative size and dimensions of the tubular members which together make up vertical center partition member 103. For example, tubular vertical posts 127, 129, 130, and 131 are tubular steel members which are four inches (4") by ten inches (10"), with a thickness of material of five sixteenths of an inch (5/16"). Diagonal braces 211, 213, 215, 219, and horizontal brace 221 are ten inches (10") by four inches (4") by three sixteenths of an inch (3/16") thickness. Base members 203, 205, 207, and 209 are three eighths of an inch (3/8") by two and three quarters inch (2 3/4") bars. Top rail 135 is ten inches by four inches, by three eighths of an inch thick.

The pieces are coupled together by gussets. Gusset 321 couples tubular top rail 103, tubular vertical post 127, and diagonal brace 203. Gusset 325 couples rectangular base 106, planar deck 108, vertical tubular post 127, and diagonal brace 205. Gusset 323 couples tubular top rail 103, vertical tubular posts 129, 130, and diagonal braces 207, 211. Gusset 327 couples generally rectangular base structure 106, planar deck 108, vertical tubular posts 129, 130, and diagonal braces 209, 213. Gusset 324 connects diagonal braces 203, 205, 207, and 209. Gusset 333 couples tubular vertical post 131 to rectangular base structure 106 and deck 108. Gusset 331 couples tubular vertical post 131 to diagonal braces 211, 213, 215, 219, and to horizontal brace 221. Gusset 329 couples tubular top rail 135 to tubular vertical post 131. Gusset 339 couples tubular top rail 125, diagonal brace 215, and bulkhead 107. Gusset 335 couples bulkhead 107, rectangular base 106, deck 108, and diagonal brace 219. Gusset 337 couples horizontal brace 221 to bulkhead 107. It is likely that the gussets could be replaced in large scale production of the railcar with interlocking connectors that are cast into the pieces to facilitate assembly.

Figure 7:
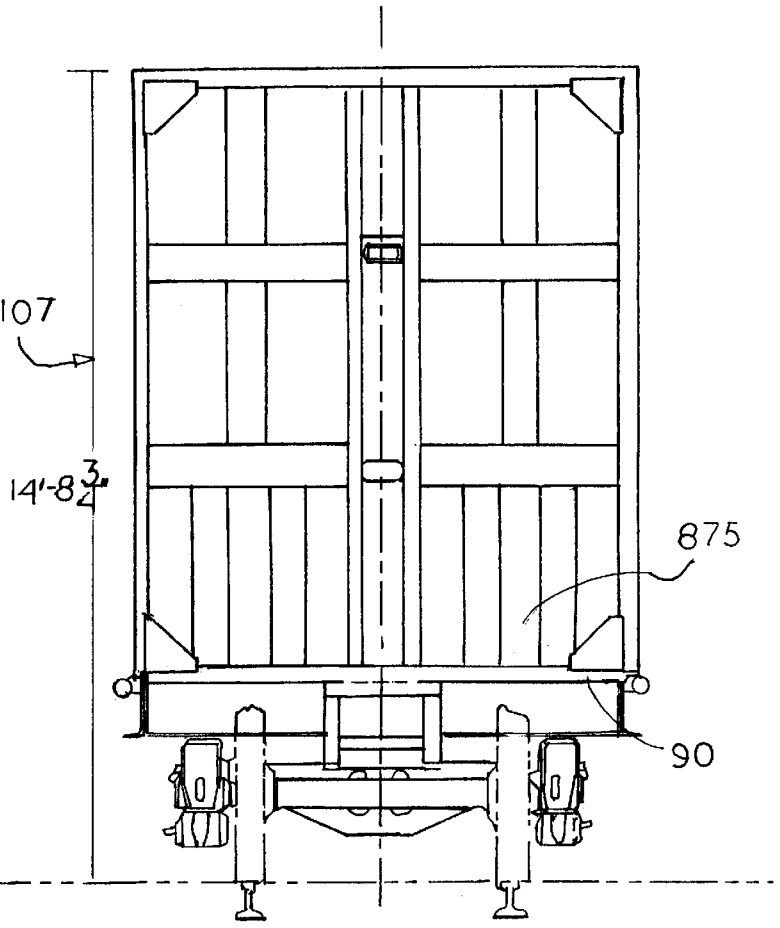
FIGS. 6 and 7 are cross-section and end views of the preferred embodiment of the flatbed railcar of the present invention.
Figure 6:
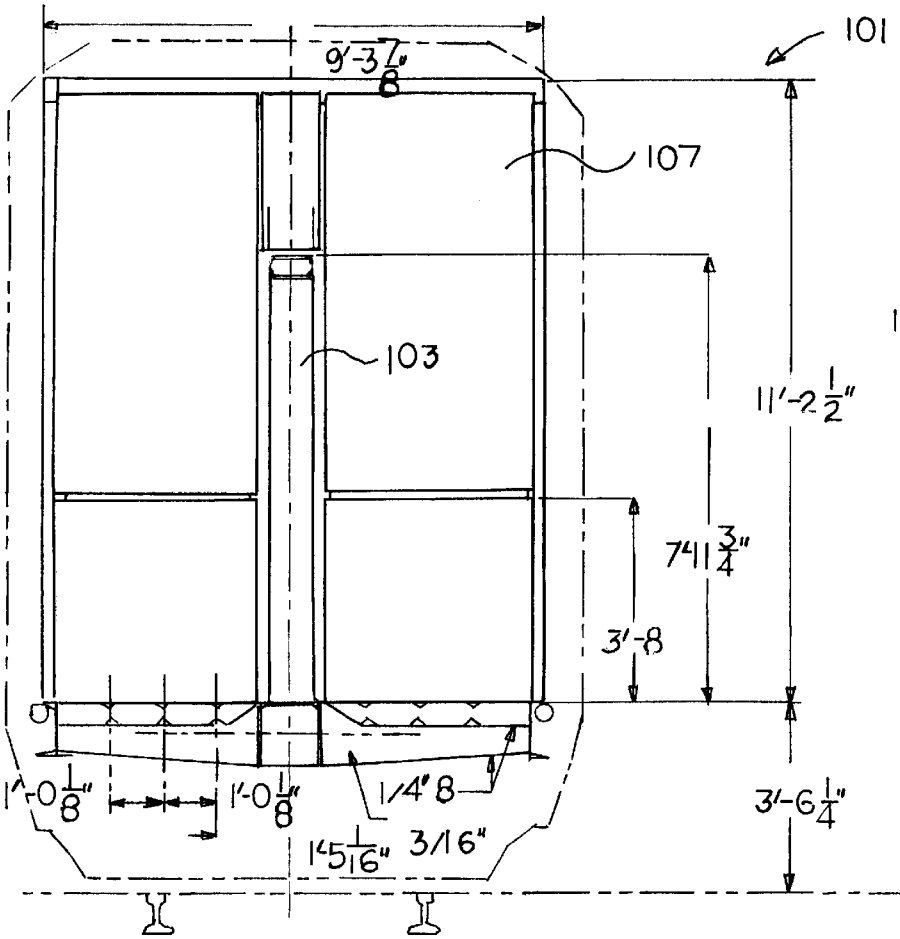

FIG. 6 is a section view through flatbed railcar 101 depicting the relative height of vertical center partition member 103 to bulkhead 107. FIG. 7 is an end view of the structural components which make up the vertical and horizontal load bearing members of bulkhead 107.

In the preferred embodiment of the present invention web straps are utilized (instead of cables) to secure the loads from shifting. This is safer and less likely to damage the cargo. Also, no risers are utilized on the deck, allowing unlimited loading configurations with either steel or lumber.

What is claimed is:

1. A railcar, comprising:

(a) a generally rectangular base structure;

(b) a substantially planar deck covering an upper surface of said base structure;

(c) a plurality of rail wheel assemblies coupled to a lower surface of said base structure and adapted for engaging a railroad;

(d) a first bulkhead member coupled to a first end of said base structure;

(e) a second bulkhead member coupled to a second end of said base structure;

(f) a vertical center partition member substantially perpendicular to said base structure, located along a longitudinal centerline relative to said base structure, extending between said first and second bulkhead members, and coupled to said first and second bulkhead members in force-transference therewith, said vertical center partition member being of substantially uniform width over the entire height thereof; and (g) wherein said vertical center partition member provides lateral bending stiffness, vertical bending stiffness, and torsional stiffness.

2. A railcar according to claim 1, wherein said vertical center partition member has a substantially uniform width from a lowermost position adjacent said substantially planar deck to an uppermost portion in order to facilitate loading and unloading operations utilizing overhead cranes.

3. A railcar according to claim 1, wherein said vertical center partition member includes a plurality of tubular vertical posts which provide lateral bending stiffness.

4. A railcar according to claim 1, wherein said vertical center partition member includes a tubular top rail which is located at an upper portion of said vertical center partition and which extends between said first and second bulkheads to provide vertical bending stiffness.

5. A railcar according to claim 1, wherein said vertical center partition member includes a plurality of diagonal brace members which provide torsional stiffness.

6. A railcar, comprising:

(a) a generally rectangular base structure;

(b) a substantially planar deck covering an upper surface of said base structure;

(c) a plurality of rail wheel assemblies coupled to a lower surface of said base structure and adapted for engaging a railroad;

(d) a first bulkhead member coupled to a first end of said base structure;

(e) a second bulkhead member coupled to a second end of said base structure; and (f) a vertical center partition member substantially perpendicular to said base structure, located along a longitudinal centerline relative to said base structure, extending between said first and second bulkhead members, and coupled to said first and second bulkhead members in force-transference therewith, including (1) a plurality of vertical posts extending upward from said base structure to provide lateral bending stiffness;

(2) a plurality of diagonal brace members extending between said plurality of vertical posts to provide torsional stiffness, said plurality of diagonal brace members extending between adjacent vertical posts; and (3) a top rail which is located at an upper portion of said vertical center partition member, and which extends between said first and second bulkheads to provide vertical bending stiffness.

7. A railcar according to claim 6, wherein said vertical center partition member has a substantially uniform width from a lowermost position adjacent said substantially planar deck to an uppermost portion in order to facilitate loading and unloading operations utilizing cranes.

8. A railcar according to claim 6, wherein said vertical center partition member extends above said planar deck a height amount which is less than a height amount of said first and second bulkheads.

9. A railcar according to claim 8, wherein said vertical center partition member extends approximately eight feet above said planar deck.

10. A railcar, comprising:

(a) a generally rectangular base structure;

(b) a substantially planar deck covering an upper surface of said base structure;

(c) a plurality of rail wheel assemblies coupled to a lower surface of said base structure and adapted for engaging a railroad;

(d) a first bulkhead member coupled to a first end of said base structure;

(e) a second bulkhead member coupled to a second end of said base structure; and (f) a vertical center partition member substantially perpendicular to said base structure, located along a longitudinal centerline relative to said base structure, extending between said first and second bulkhead members, and coupled to said first and second bulkhead members in force-transference therewith, including:

(1) a plurality of vertical posts extending upward from said base structure to provide lateral bending stiffness;

(2) a pair of intersecting diagonal brace members extending between said plurality of vertical posts to provide torsional stiffness, said pair of intersecting diagonal brace members extending between adjacent vertical posts; and (3) a top rail which is located at an upper portion of said vertical center partition member, and which extends between said first and second bulkheads to provide vertical bending stiffness.

11. A railcar according to claim 10, wherein said vertical center partition member has a substantially uniform width from a lowermost position adjacent said substantially planar deck to an uppermost portion in order to facilitate loading and unloading operations utilizing cranes.

12. A railcar according to claim 10, wherein said vertical center partition member extends above said planar deck a height amount which is less than a height amount of said first and second bulkheads.

13. A railcar according to claim 12, wherein said vertical center partition member extends approximately eight feet above said planar deck.

14. A railcar, comprising:

(a) a generally rectangular base structure;

(b) a substantially planar deck covering an upper surface of said base structure;

(c) a plurality of rail wheel assemblies coupled to a lower surface of said base structure and adapted for engaging a railroad;

(d) a first bulkhead member coupled to a first end of said base structure;

(e) a second bulkhead member coupled to a second end of said base structure; and (f) a vertical center partition member substantially perpendicular to said base structure, located along a longitudinal centerline relative to said base structure, extending between said first and second bulkhead members, and coupled to said first and second bulkhead members in force-transference therewith, including:

(1) a plurality of vertical posts extending upward from said base structure to provide lateral bending stiffness;

(2) a plurality of diagonal brace members extending between said plurality of vertical posts to provide torsional stiffness; and (3) a top rail which is located at an upper portion of said vertical center partition member, and which extends between said first and second bulkheads to provide vertical bending stiffness;

wherein said vertical center partition member extends above said planar deck a height amount which is less than a height amount of said first and second bulkheads.

15. A railcar, comprising:

(a) a generally rectangular base structure;

(b) a substantially planar deck covering an upper surface of said base structure;

(c) a plurality of rail wheel assemblies coupled to a lower surface of said base structure and adapted for engaging a railroad;

(d) a first bulkhead member coupled to a first end of said base structure;

(e) a second bulkhead member coupled to a second end of said base structure; and (f) a vertical center partition member substantially perpendicular to said base structure, located along a longitudinal centerline relative to said base structure, extending between said first and second bulkhead members, and coupled to said first and second bulkhead members in force-transference therewith, including:

(1) a plurality of vertical posts extending upward from said base structure to provide lateral bending stiffness;

(2) a plurality of diagonal brace members extending between said plurality of vertical posts to provide torsional stiffness; and (3) a top rail which is located at an upper portion of said vertical center partition member, and which extends between said first and second bulkheads to provide vertical bending stiffness;

wherein said vertical center partition member extends above said planar deck a height amount which is less than a height amount of said first and second bulkheads; and wherein said vertical center partition member extends approximately eight feet above said planar deck.

16. A railcar, comprising:

(a) a generally rectangular base structure;

(b) a substantially planar deck covering an upper surface of said base structure;

(c) a plurality of rail wheel assemblies coupled to a lower surface of said base structure and adapted for engaging a railroad;

(d) a first bulkhead member coupled to a first end of said base structure;

(e) a second bulkhead member coupled to a second end of said base structure; and (f) a vertical center partition member substantially perpendicular to said base structure, located along a longitudinal centerline relative to said base structure, extending between said first and second bulkhead members, and coupled to said first and second bulkhead members in force-transference therewith, including:

(1) a plurality of vertical posts extending upward from said base structure to provide lateral bending stiffness;

(2) a pair of intersecting diagonal brace members extending between said plurality of vertical posts to provide torsional stiffness; and (3) a top rail which is located at an upper portion of said vertical center partition member, and which extends between said first and second bulkheads to provide vertical bending stiffness;

wherein said vertical center partition member extends above said planar deck a height amount which is less than a height amount of said first and second bulkheads.

17. A railcar, comprising:

(a) a generally rectangular base structure;

(b) a substantially planar deck covering an upper surface of said base structure;

(c) a plurality of rail wheel assemblies coupled to a lower surface of said base structure and adapted for engaging a railroad;

(d) a first bulkhead member coupled to a first end of said base structure;

(e) a second bulkhead member coupled to a second end of said base structure; and (f) a vertical center partition member substantially perpendicular to said base structure, located along a longitudinal centerline relative to said base structure, extending between said first and second bulkhead members, and coupled to said first and second bulkhead members in force-transference therewith, including:

(1) a plurality of vertical posts extending upward from said base structure to provide lateral bending stiffness;

(2) a pair of intersecting diagonal brace members extending between said plurality of vertical posts to provide torsional stiffness; and (3) a top rail which is located at an upper portion of said vertical center partition member, and which extends between said first and second bulkheads to provide vertical bending stiffness;

wherein said vertical center partition member extends above said planar deck a height amount which is less than a height amount of said first and second bulkheads; and wherein said vertical center partition member extends approximately eight feet above said planar deck.

18. A railcar, comprising:

(a) a generally rectangular base structure;

(b) a substantially planar deck covering an upper surface of said base structure;

(c) a plurality of rail wheel assemblies coupled to a lower surface of said base structure and adapted for engaging a railroad;

(d) a first bulkhead member coupled to a first end of said base structure;

(e) a second bulkhead member coupled to a second end of said base structure; and (f) a flangeless vertical center partition member substantially perpendicular to said base structure, located along a longitudinal centerline relative to said base structure, extending between said first and second bulkhead members, and coupled to said first and second bulkhead members in force-transference therewith;

wherein said vertical center partition member provides lateral bending stiffness, vertical bending stiffness, and torsional stiffness.

19. A railcar, comprising:

(a) a generally rectangular base structure;

(b) a substantially planar deck covering an upper surface of said base structure;

(c) a plurality of rail wheel assemblies coupled to a lower surface of said base structure and adapted for engaging a railroad;

(d) a first bulkhead member coupled to a first end of said base structure;

(e) a second bulkhead member coupled to a second end of said base structure; and (f) a vertical center partition member substantially perpendicular to said base structure, located along a longitudinal centerline relative to said base structure, extending between said first and second bulkhead members, and coupled to said first and second bulkhead members in force-transference therewith;

wherein said vertical center partition member extends above said planar deck a height amount which is less than a height amount of said first and second bulkheads.

* * * * *